United States Patent [19]

Laboy-Alvarado

[11] 4,004,652

[45] Jan. 25, 1977

[54] PORTABLE BRIDGE STRUCTURE

[76] Inventor: Samuel Laboy-Alvarado, P.O. Box 8637 Fernandez Juncos Sta., Santurce, P.R. 00910

[22] Filed: Apr. 12, 1976

[21] Appl. No.: 675,746

[52] U.S. Cl. ..... 182/118; 182/1; 182/152

[51] Int. Cl.[2] ..... E04G 1/30

[58] Field of Search ..... 182/118, 119, 179, 1, 182/152, 27, 161, 151

[56] References Cited

UNITED STATES PATENTS

| | | | |
|---|---|---|---|
| 215,234 | 5/1879 | Mikeal | 182/118 |
| 678,695 | 7/1901 | Schoenhut | 182/118 |
| 679,003 | 7/1901 | McRay | 182/118 |
| 925,598 | 6/1909 | Rentfrow | 182/118 |
| 1,115,803 | 11/1914 | Gallagher | 182/118 |
| 3,250,344 | 5/1966 | Romano | 182/118 |
| 3,709,323 | 1/1973 | Trible | 182/1 |

*Primary Examiner*—Reinaldo P. Machado

*Attorney, Agent, or Firm*—Warren N. Low; Richard P. Matthews

[57] ABSTRACT

A portable bridge structure includes a pair of releasably connectable stair and platform assemblies which form opposite ends of the bridge structure. Each assembly includes several components which are movable between folded and erected positions. When all the components are in their folded positions, each assembly forms a flat, compact bundle to facilitate transport and storage of the bridge structure. The components of each assembly include pivotally interconnected stair and platform sections and bracing means for retaining the sections in erected positions at selected angles of relative inclination. In preferred practice, each assembly also includes foldable stabilizer and railing structures carried respectively on the stair and platform sections.

10 Claims, 8 Drawing Figures

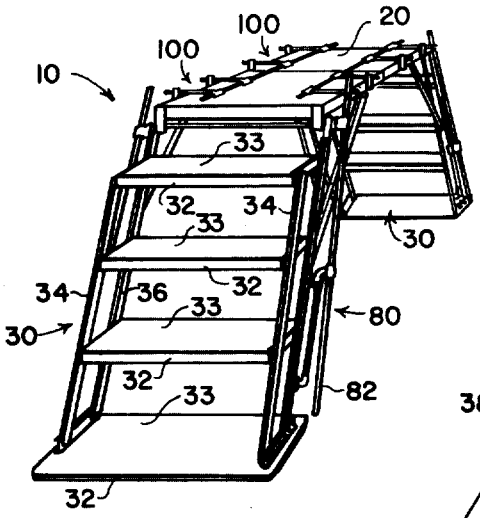
FIG. 5
FIG. 6
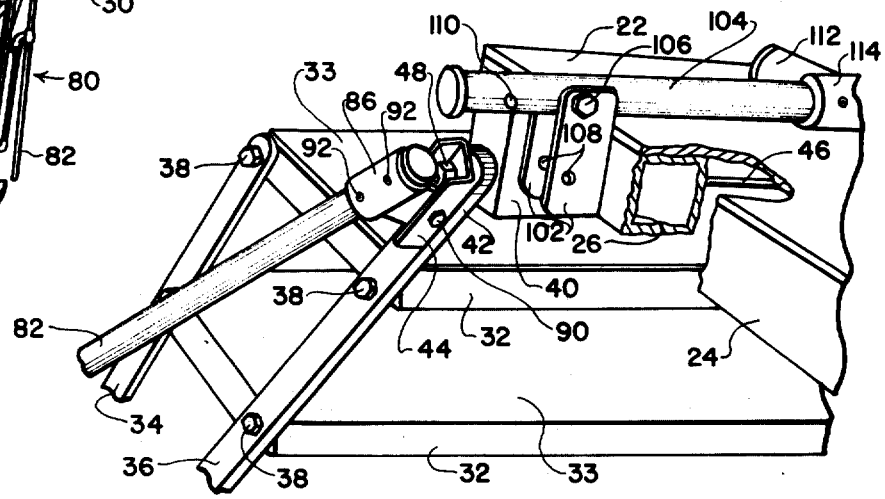
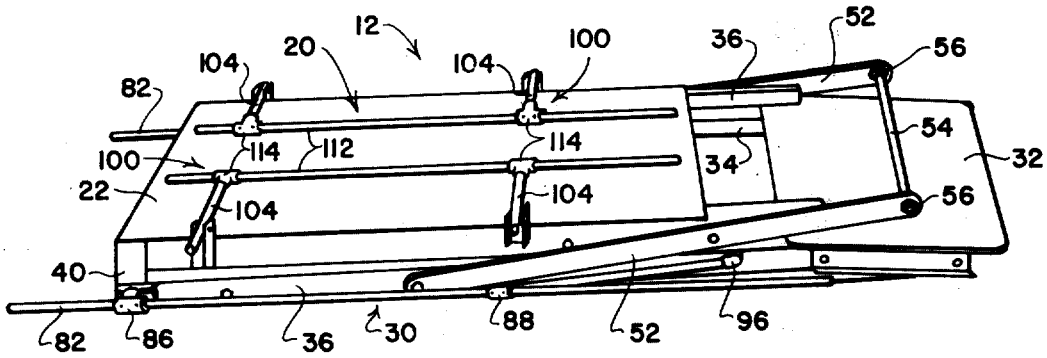
FIG. 7
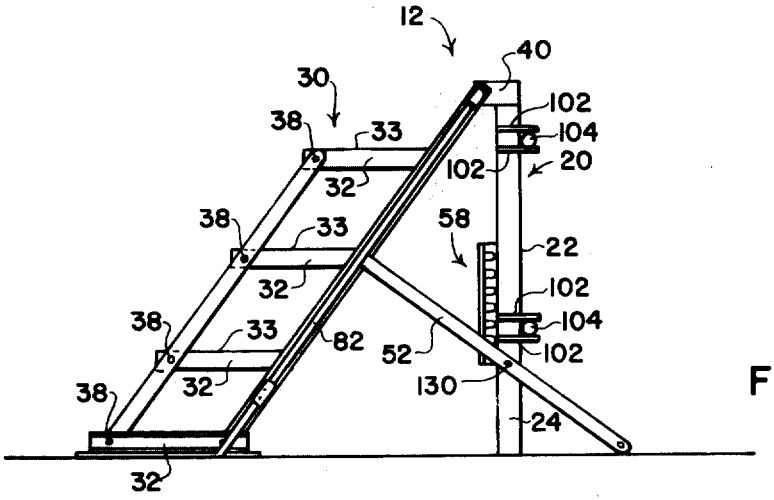
FIG. 8

PORTABLE BRIDGE STRUCTURE

BACKGROUND OF THE INVENTION

The present invention relates generally to portable platform structures, and more particularly to a portable bridge structure formed from releasably interconnected assemblies which are easily folded into flat, compact bundles for transport and storage.

While the prior art includes many proposals for portable ladders, scaffolding and bridge-like structures, these proposals fail to provide a simple, lightweight portable bridge structure having a platform supported at opposite ends by stairs and formed from assemblies which are foldable into flat compact bundles for transport and storage, which include stair treads of sufficient depth to permit persons carrying sizable loads to comforatably ascend and descend the stairs, and which are adjustable both to vary the height of the platform and to accommodate variations in ground height.

SUMMARY OF THE INVENTION

The present invention overcomes the foregoing and other drawbacks of the prior art by providing a novel and improved, highly versatile, portable bridge structure formed from assemblies which can be folded into flat, compact bundles for transport and storage.

Bridge structures embodying the preferred practice of the present invention include a pair of stair and platform assemblies, each of which has components that are movable between folded and erected positions. In their folded positions, the components of each assembly lie closely alongside each other and form a flat, compact bundle. In their erected positions, the components of each assembly form cooperate to define one end region of a bridge.

Each of the stair and platform assemblies includes a platform section and a stair section, and assembly connection means is provided to interconnect the platform sections to form a bridge with the stair sections at opposite ends of the bridge.

Each of the stair and platform assemblies also includes section interconnection means which pivotally interconnects its stair and platform sections for movement between assembly folded and assembly erected positions.

Each of the stair and platform assemblies further includes bracing means for releasably maintaining its stair and platform sections in one of a plurality of predetermined assembly erected positions. Each of the bracing means is pivotally connected to one of its sections for movement between brace folded and brace erected positions, and is selectively connectable when in brace erected positions with one of a plurality of formations carried on the other section. This arrangement permits the relative angles of inclination between interconnected step and platform sections to be adjusted as may be required to accommodate variations in ground surface level and to adjust the height above ground level of the platform sections.

Each of the stair sections includes a plurality of tread members. Support means pivotally connects with the tread members and maintains load support surfaces defined on the tread members in substantially parallel relationship as the tread members pivot relative to the support means between stair folded and stair erected positions.

Siderail assemblies are preferably carried on the platform sections and are movable between siderail folded and siderail erected positions. In their folded positions, the siderail assemblies lie closely alongside their associated platform sections.

Stabilizer assemblies are preferably carried on the stair sections and are movable between stabilizer folded and stabilizer erected positions. In their folded positions, the stabilizer assemblies lie closely alongside their associated stair sections. In their erected positions, the stabilizer assemblies are operable to engage the surface on which the bridge structure is supported to laterally stabilize the bridge structure.

A platform extension section is preferably provided for installation between the platform sections when it is desired to lengthen the bridge structure. Foldable railing assemblies are provided on the extension section.

Bridge structures of the type embodying the present invention are highly versatile. They are well suited for use in construction areas as work platforms, and to bridge trenches and freshly poured concrete. They have rural and residential uses in bridging fences and creeks. Many other uses will be apparent.

The stair and platform assemblies can be used independently of each other to form staircases or display stands. The assemblies can be placed side by side to form double width staircases for unloading trucks and the like. In similar fashion, a plurality of the bridge structures can be placed side by side to increase bridge width.

One feature of the present invention is that it permits the use of deep stair treads which can be ascended and descended easily, and yet does not sacrifice the foldability of the assemblies into compact, flat bundles. Another feature is that the lowermost stair tread of each assembly adjusts its angle to rest flatly on the underlying ground surface, regardless of the angle of inclination of its stair section. Since all the treads of each stair section are interconnected, treads above the lowermost tread automatically orient themselves in parallel relationship to the lowermost tread.

In preferred practice, substantially all of the components of the bridge structure are formed from a relatively lightweight material such as aluminum. Where the components are formed from aluminum, a satisfactorily strong and stable bridge can be formed with stair and platform assemblies that weigh less than 50 pounds each.

Other features and a fuller understanding of the invention may be had by referring to the following description and claims taken in conjunction with the accompanying drawings.

BRIEF DESCRIPTION OF THE DRAWINGS

FIG. 5 is a perspective view of the bridge structure with its stabilization and railing assemblies folded;

FIG. 6 is an enlarged perspective view of a portion of the bridge structure with part of the structure broken away and shown in cross-section;

FIG. 7 is a perspective view of one bridge assembly with its components folded; and FIG. 8 is a side elevational view on one bridge assembly positioned for use as a staircase.

DESCRIPTION OF THE PREFERRED EMBODIMENT

Figure 1:
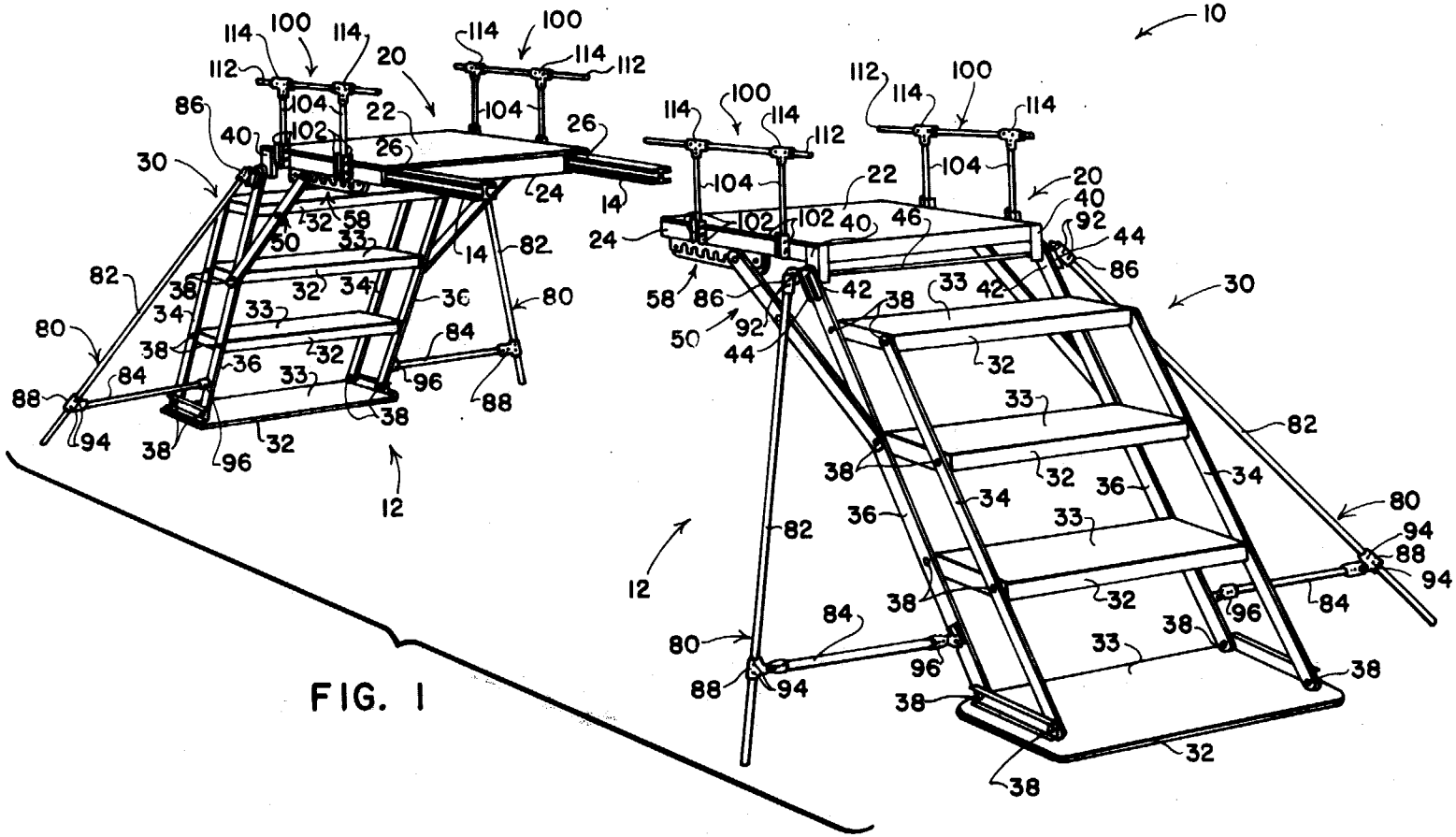
FIG. 1 is an exploded perspective view of a bridge structure embodying the preferred practice of the present invention.
Figure 2:
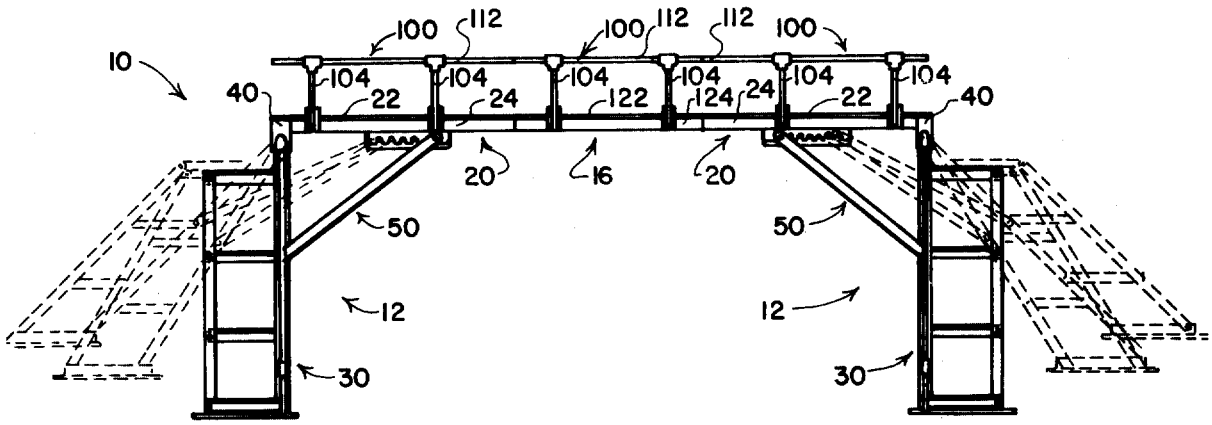
FIG. 2 is a side elevational view of the bridge structure including an extension section and illustrating in phantom various erected positions of stair sections of the bridge.

Referring to FIG. 1, a portable bridge structure is indicated generally by the numeral 10. The structure 10 includes a pair of substantially identical stair and platform assemblies 12, and a pair of beams 14 for releasably interconnecting the assemblies 12. An extension assembly 16 may be interposed between the stair and platform assemblies to form a relatively long bridge, as shown in FIG. 2, or the assemblies 12 may be joined by the beams 14 to form a somewhat shorter bridge.

Each of the assemblies 12 includes a platform section 20 and a stair section 30. Bracing assemblies 50 are provided to retain the relatively movable sections 20, 30 in erected positions. Stabilizing assemblies 80 are carried on the stair sections 30 to assist in laterally stabilizing the erected bridge structure 10. Railing assemblies 100 are carried on the platform sections 20. As will be explained in greater detail, pivotal connections formed between relatively movable components of the assemblies 12 permit each of the assemblies 12 to be folded into a compact, substantially flat bundle for ease of handling and storage.

Each of the platform sections 20 includes a substantially rectangular floor plate 22 supported atop a frame 24. Parallel extending passages 26 are formed in opposite sides of the frame 24. The passage 26 formed in one of the frames 24 aligns with the passages 26 formed in the other of the frames 24 when the platform sections 20 are abutted end-to-end for interconnection.

The beams 14 are slidably insertable into the passages 26 to interconnect the platform sections 20. Suitable fasteners, not shown, preferably extend through aligned holes formed in the frames 24 and in the beams 14 to maintain the platform sections 20 in abutting, connected relationship.

Each of the stair sections 30 includes a plurality of rectangular tread members 32. Substantially planar load support surfaces 33 are defined by the tread members. Forward and rearward pairs of elongated support bars 34, 36 interconnect the tread members 32. Fasteners 38 extend through aligned holes formed in the tread members 32 and in the support bars 34, 36 to pivotally connect the tread members 32 to the support bars 34, 36.

The support bars 34, 36 of each stair section 30 extend parallel to each other and cooperate with the tread members 32 to define parallelogram linkages which will maintain a parallel relationship between their support surfaces 33. A feature of the described stair section construction is that the lowermost of the tread members 30 will tend to lie flat on a ground surface and will thereby cause the overlying support surfaces 33 to be oriented parallel to the ground surface, regardless of the angle of inclination of the support bars 34, 36.

Pivotal connections are formed between the platform and stair sections 20, 30 of each assembly 12. A pair of brackets 40 depend from each of the platform sections 20. The rearward support bars 36 have upper end regions 42 which extend alongside the brackets 40. Referring to FIG. 6 in conjunction with FIG. 1, channel-shaped members 44 are positioned beside the upper end regions 42. Rods 46 extend through aligned holes formed in the brackets 40, in the end regions 42, and in the members 44. Nuts 48 are threaded onto opposite ends of the rods 46. The interconnected platform and stair sections 20, 30 are relatively pivotally movable about the axes of the rods 46.

Referring to FIG. 2, a feature of the described pivotally interconnected platform and stair sections 20, 30 is that the stair sections 30 may be oriented at various angles of inclination relative to the platform sections 20. By varying the angles of inclination of the stair sections 30, the height of the platform sections 20 above a ground surface can be adjusted, and ground surfaces having different elevations at opposite ends of the bridge structure 10 can be accommodated.

The bracing assemblies 50 provide a means of retaining the stair sections 30 at selected angles of inclination relative to the platform sections 20. Each of the bracing assemblies 50 includes a U-shaped structure having a pair of arms 52 interconnected by a rod 54, as best seen in FIG. 7. Nuts 56 are threaded onto opposite end regions of the rod 54 to form a rigid connection between the arms 52 and the rod 54.

Referring again to FIG. 1, opposite ends of the arms 52 are pivotally connected to the rearward support members 36 by opposed pairs of the fasteners 38. A pair of connector assemblies 58 is carried on each of the platform frames 24. The connector assemblies 58 define a plurality of formations adapted to releasably receive the rods 54 to retain the stair sections 30 at selected angles of inclination relative to the platform sections 20.

Figure 3:
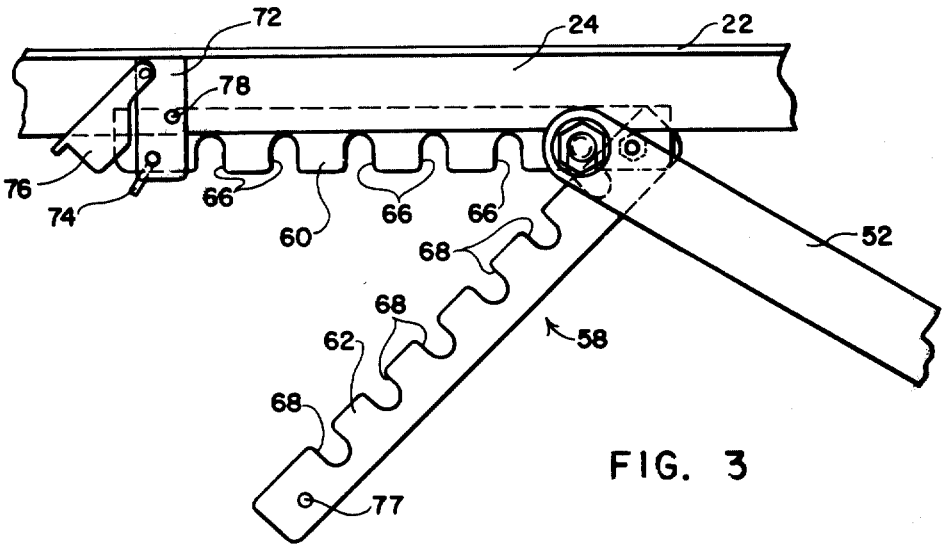
FIGS. 3 and 4 are enlarged side elevational views of a portion of the bridge structure illustrating the operation of a brace connection assembly.
Figure 4:
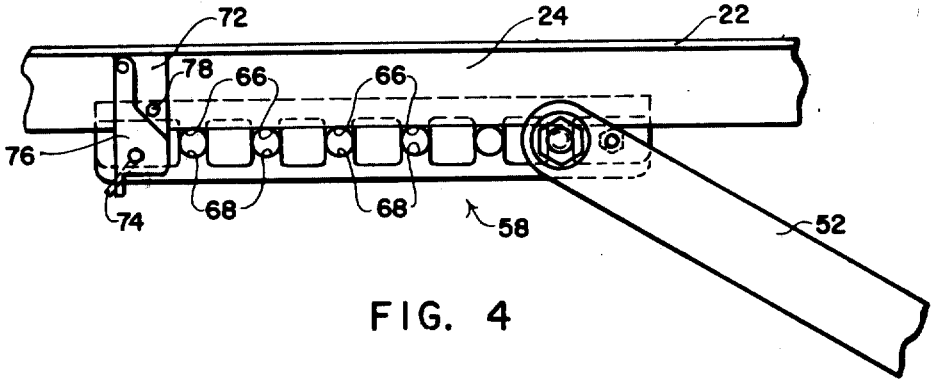

Referring to FIGS. 3 and 4, each of the connector assembles 58 includes an elongated base member 60 and an elongated locking member 62. Each of the base members 60 is rigidly supported on its associated platform frame 24. Threaded fasteners 64 extend through aligned holes formed through end regions of the members 60, 62. The fasteners 64 pivotally mount the locking members 62 on the base members 60 for movement between open and closed positions, such as are shown in FIGS. 3 and 4, respectively.

A plurality of downwardly opening slots 66 are formed in each of the base members 60. A plurality of upwardly opening slots 68 are formed in each of the locking members 62. When the members 60, 62 are in their closed positions, each of the slots 66 aligns with a separate one of the slots 68 to define a hole-like formation which can releasably receive one of the rods 54.

Each of the connector assemblies 58 additionally includes a latching assembly 70 for retaining its members 60, 62 in their closed position. Each of the latching assemblies 70 includes a bracket 72, a latch pin 74, a pin retainer 76, and a retainer stop 78. The brackets 72 are rigidly connected to the frames 24. The latch pins 74 are slidably carried in aligned holes formed through the brackets 72 and through the base members 60. When the member 60, 62 are in their closed positions, the pins 74 are slidable into holes 77 formed in the members 62 to releasably retain the members 60, 62 in their closed positions.

The pin retainers 76 are pivotally carried on the brackets 72 for movement between pin-released and pin-retained positions shown in FIGS. 3 and 4, respectively. Each of the retainers 76 can be moved to its pin-retained position only after its associated latch pin 74 has been pushed inwardly to a position where its head clears the plane in which the retainer 76 pivots. If the members 60, 62 are closed when the pins 74 are pushed inwardly, the pins 74 will extend into the holes 77 and will serve to retain the members 60, 62 closed. Once the retainers 76 are in their pin-retained positions, they prevent outward movement of the pins 74.

The retainers 76 tend to pivot under the influence of gravity toward their pin-retained positions. The stops 78 are projections carried on the brackets 72. The stops 78 engage the retainers 76 when the retainers 76 are in their pin-retained positions.

When the members 60, 62 are in their open position, the rods 54 can be positioned in selected ones of the slots 66 to adjust the relative angles of inclination between the platform and stair sections 20, 30. Once the members 62 are moved to their closed positions, the pins 74 are inserted into the holes 77 and the retainers 76 are pivoted into engagement with the stops 78, the rods 54 are then securely locked in the selected slots 66.

Referring to FIGS. 1, 5 and 6, each of the stabilizing assemblies 80 includes a strut 82 and a brace 84. Connectors 86, 88 slidably receive opposite end regions of the struts 82 and pivotally connect the struts 82 to the brackets 44 and to the braces 84, respectively. Threaded fasteners 90 extend through aligned holes formed in the brackets 44 and in the connectors 86 to form pivotal connections therebetween. Set screws 92, 94 are threaded through holes formed in the connectors 86, 88 for releasably rigidly connecting the struts 82 and the connectors 86, 88.

Connectors 96 establish pivotal connections between braces 84 and the support members 36. The sliding and pivotal connections provided by the connectors 86, 88, 96 permit the stabilizing assemblies 80 to be moved between erected and folded positions, as shown in FIGS. 1 and 5, respectively.

Referring to FIGS. 1 and 6, the railing assemblies 100 each include two pairs of brackets 102 mounted along the sides of the platform frames 24. Railing uprights 104 extend between each pair of brackets 102. Threaded fasteners 106 extend through aligned holes formed in the brackets 102 and in the uprights 104 to pivotally mount the uprights 104 on the brackets 102. Additional holes 108, 110 are formed through the brackets 102 and through the uprights 104. When the uprights 104 are pivoted to the position shown in FIG. 1, the associated holes 108, 110 align and pins, not shown, can be inserted through these aligned holes to lock the uprights 104 in an erect attitude.

The railing assemblies 100 also each include a railing bar 112. Connectors 114 rigidly connect the railing bars 112 to the uprights 104. When the uprights 104 are pivoted to folded positions, as shown in FIGS. 5 and 6, the railing bars 112 and the uprights 104 lie closely alongside the platform surfaces 22 to facilitate storage and transportation of the bridge assemblies 12.

Referring to FIG. 2, the extension section 16 includes a substantially rectangular floor plate 122 supportd atop a frame 124. The beams 14 extend from the frame 24 of one of the assemblies 22 through the frame 124 of the extension section 16 and into the frame 24 of the other of the assemblies 12 to rigidly interconnect the sectons 16, 20. Foldable railing assemblies 100 are provided on the extension section 16.

Each of the assemblies 12 can be folded to form a compact flat bundle to facilitate transportation and storage. As is illustrated in FIG. 7, when folded, the assembly 12 has its relatively movable components extending closely alongside each other.

Each of the assemblies 12 can be used independently to form a stable set of steps. As is illustrated in FIG. 8, the platform section 20 can be used as a support for the upper end of the stair section 30. Threaded fasteners 130 can be inserted through aligned holes in the arms 52 and in the frames 24 to rigidly interconnect the platform and stair assemblies 20, 30.

Although the invention has been described in its preferred form with a certain degree of particularity, it is understood that the present disclosure of the preferred form has been made only by way of example and numerous changes in the details of construction and the combination and arrangement of parts may be resorted to without departing from the spirit and the scope of the invention as hereinafter claimed. It is intended that the patent shall cover, by suitable expression in the appended claims, whatever features of patentable novelty exist in the invention disclosed.

What is claimed is:

1. A portable bridge structure, comprising:

a. a pair of stair and platform assemblies each including a stair section and a platform section, and assembly interconnection means for releasably connecting the platform sections to form a bridge with the stair sections at opposite ends of the bridge;

b. each of the assemblies including section interconnection means pivotally connecting its stair and platform sections for movement between assembly folded and assembly erected positions;

c. each of the assemblies additionally including bracing means for releasably maintaining its stair and platform sections in one of a plurality of predetermined assembly erected positions, the bracing means being pivotally connected to one of the sections for movement between brace folded and brace erected positions and being selectively connectable when in brace erected positions with one of a plurality of formations carried on the other sections;

d. each of the stair sections including a plurality of tread members and support means pivotally connected to the tread members for maintaining load support surfaces defined on the tread members in substantially parallel relationship as the tread members pivot relative to the support means between stair folded and stair erected positions;

e. the sections, bracing means, tread members and support means of each assembly being operative when in the assembly folded, brace folded and stair folded positions, respectively, to lie closely alongside each other to form a compact, substantially flat bundle.

2. The bridge structure of claim 1 wherein the support means of each stair section includes forward and rearward pairs of elongated support members pivotally connected to their tread members and cooperating therewith to define parallelogram linkages which maintain the load support surfaces in parallel relationship.

3. The bridge structure of claim 2 wherein the section interconnecting means pivotally connects with the rearward pairs of support members.

4. The bridge structure of claim 2 additionally including stabilization means connected to the rearward pairs of support members for laterally stabilizing the stair sections.

5. The structure of claim 1 additionally including siderail means pivotally connected to the platform sections for movement between siderail folded and siderail erected positions, the siderail means extending closely alongside their associated platform sections when in the siderail folded positions.

6. The structure of claim 1 additionally including stabilization means pivotally connected to the stair sections for movement between stabilizer folded and stabilizer erected positions, the stabilization means extending closely alongside their associated stair sections when in the stabilizer folded positions and being operable to engage the surface on which the structure is supported at locations on opposite sides of their associated stair sections when in the stabilizer extended positions.

7. The structure of claim 1 wherein:

a. a pair of parallel passages are formed in each of the platform sections;

b. the passage in one of the platform sections is alignable with the passages in the other of the platform sections when the platform sections are arranged end to end for interconnection; and c. the assembly interconnection means includes a pair of connection members positionable in the passages of one of the platform sections and extending into the aligned passages of the other platform section to bridge the juncture between the platform sections.

8. The structure of claim 1 additionally including a platform extension section which is insertable between and connectable to the platform sections to extend the length of the bridge structure.

9. The structure of claim 5 additionally including siderail extension means pivotally connected to the platform extension section for movement between folded and extended positions.

10. The bridge structure of claim 1 additionally including:

a. siderail means pivotally connected to the platform sections for movement between siderail folded and siderail erected positions, the siderail means extending closely alongside their associated platform sections when in the siderail folded positions;

b. stabilization means pivotally connected to the stair sections for movement between stabilizer folded and stabilizer erected positions, the stabilization means extending closely alongside their associated stair sections when in the stabilizer folded positions and being operable to engage the surface on which the structure is supported at locations on opposite sides of their associated stair sections when in the stabilizer extended positions; and, c. a platform extension section which is insertable between and connectable to the platform sections to extend the length of the bridge structure.

* * * * *